United States Patent [19]

Gilmer et al.

[11] 3,996,764

[45] Dec. 14, 1976

[54] REFRIGERANT COOLING APPARATUS

[75] Inventors: Richard W. Gilmer, Lewisburg; Sanford R. Sexton, Dayton, both of Ohio

[73] Assignee: Fedders Corporation, Edison, N.J.

[22] Filed: Mar. 24, 1975

[21] Appl. No.: 561,408

[52] U.S. Cl. ..... 62/279

[51] Int. Cl.[2] ..... F25B 47/00

[58] Field of Search ..... 62/277, 279, 305

[56] References Cited

UNITED STATES PATENTS

| | | | |
|---|---|---|---|
| 3,225,563 | 12/1965 | Braun | 62/277 |
| 3,691,786 | 9/1972 | Anderson et al. | 62/279 |
| 3,869,874 | 3/1975 | Ditzler | 62/277 |

*Primary Examiner*—Lloyd L. King

*Attorney, Agent, or Firm*—McAulay, Fields, Fisher & Goldstein

[57] ABSTRACT

A room cooling refrigeration apparatus comprising a housing containing an evaporator, a compressor and condenser. A sub-cooling coil is located in a reservoir attached to contain condensate water for cooling refrigerant discharged from the condenser.

2 Claims, 6 Drawing Figures

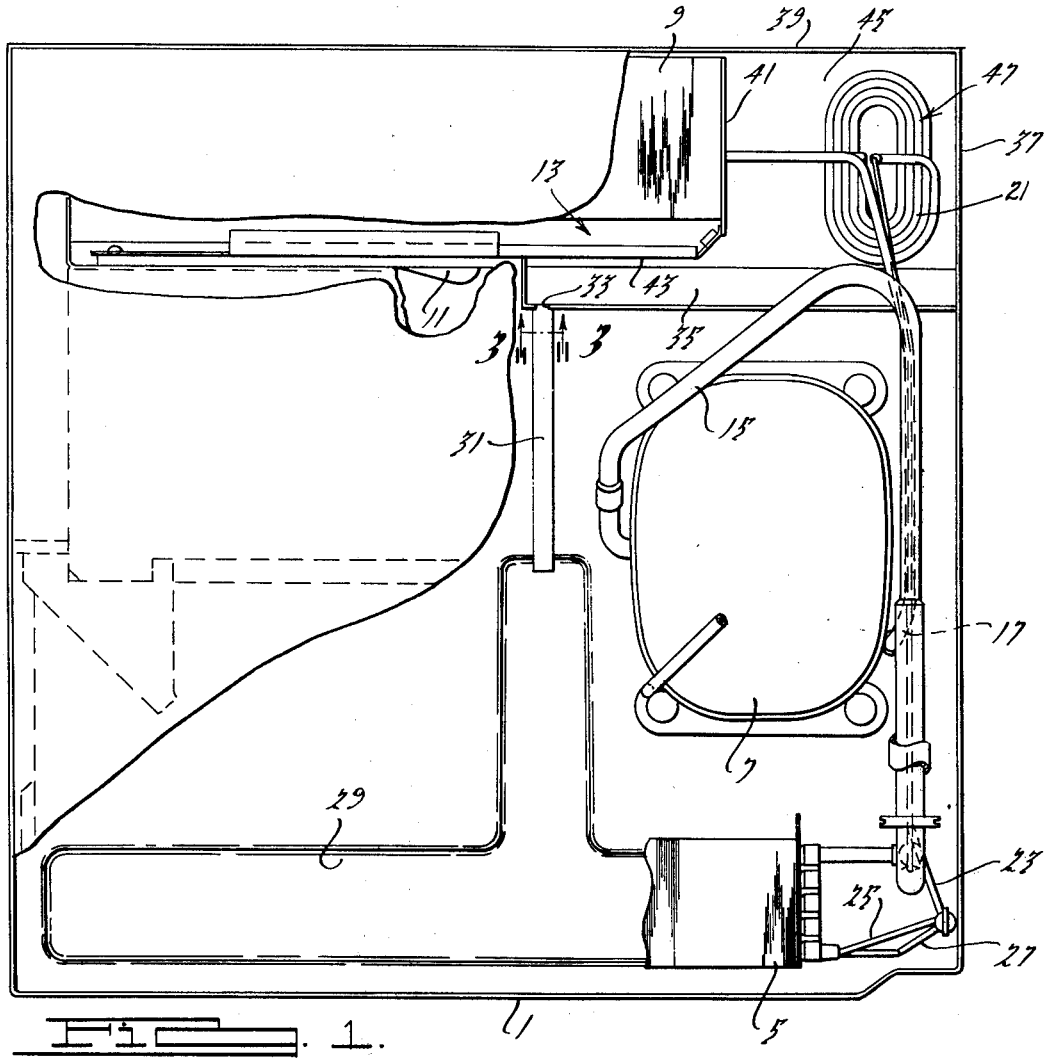
FIG. 1.
FIG. 2.
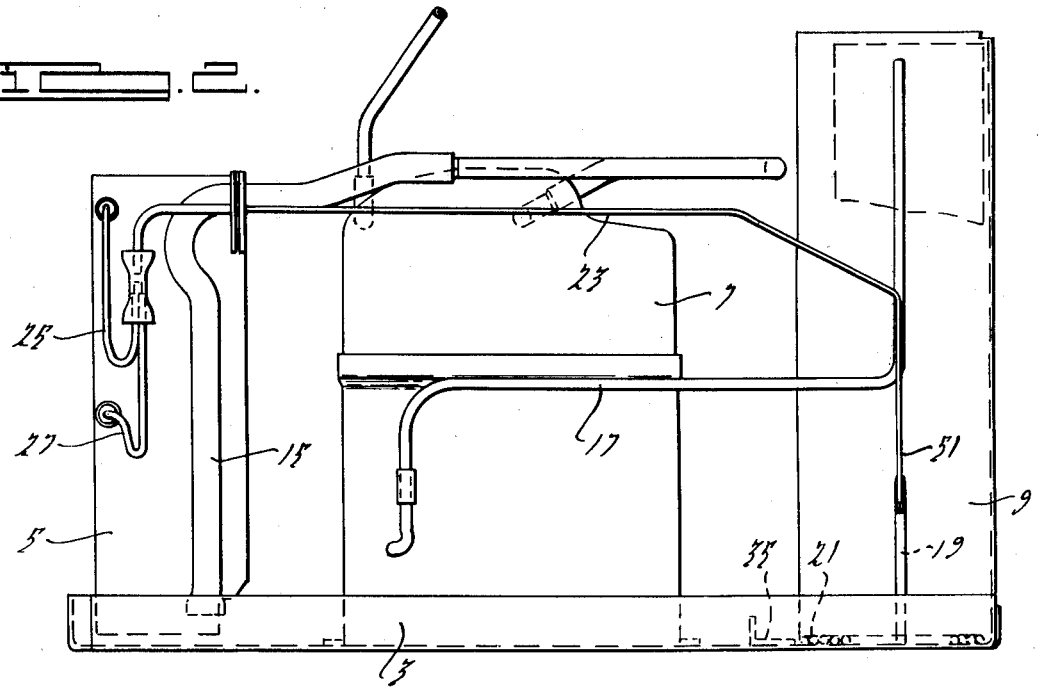

REFRIGERANT COOLING APPARATUS

BACKGROUND OF THE INVENTION

This invention relates to refrigeration apparatus, and more particularly, to apparatus for cooling refrigerant which has been compressed by a motor-driven compressor.

In many types of refrigeration apparatus, particularly refrigeration apparatus of the type often referred to as room air-conditioners, the refrigeration system includes a motor-driven compressor adapted to compress vapor refrigerant, a condenser adapted to receive the condensed refrigerant from the compressor and condense the same to a liquid state, and an evaporator in which the liquid refrigerant is vaporized and removes heat from the air passing over the evaporator. The aforementioned components are connected together by a conduit and include suitable valves for releasing refrigerant in the appropriate state for the particular component involved. As heat is removed from the air passing over the evaporator condensation is formed thereon which is drained from the evaporator equipment to the condenser compartment. This water is sometimes distributed by a slinger ring or other conventional apparatus and forced by a condenser fan over the condenser coil to facilitate the cooling of the compressed refrigerant delivered to the condenser coil. All of the aforenoted components are contained in a housing which is adapted to be placed in a window frame, for example, of a building.

The present invention relates to apparatus for sub-cooling liquid refrigerant delivered from a condenser coil prior to its arrival at the evaporator coil.

BRIEF SUMMARY OF THE INVENTION

Briefly, this invention comprises refrigeration apparatus and means for sub-cooling refrigerant which has been liquified in a condenser coil.

One of the primary objects of this invention is to provide refrigeration apparatus wherein refrigerant which has been liquified by a condenser is sub-cooled prior to its delivery to the evaporator coil.

Another object of this invention is to provide apparatus of the type described wherein condensate water is utilized to provide the sub-cooling of the refrigerant.

Still another object of the invention is to provide apparatus of the type described wherein a pool of condensate water is provided.

Still another object of this invention is to provide apparatus such as described in which a cooling coil is immersed in a pool of condensate water.

Still another object of this invention is to provide apparatus of the class described in which the depth of the pool of condensate water utilized for cooling refrigerant is prevented from exceeding a predetermined amount.

Another object of this invention is to provide apparatus of the type described which is effective in operation and economical in construction.

Other objects and advantages of this invention will be made apparent as the description progresses.

BRIEF DESCRIPTION OF THE DRAWINGS

In the accompanying drawings in which one of various possible embodiments of this invention are illustrated, FIG. 1 is a plan view of apparatus constructed in accordance with this invention, certain parts being broken away for clarity;

FIG. 2 is a side elevation of the apparatus shown in FIG. 1, certain parts being removed for clarity;

Like parts are shown by corresponding reference characters throughout the various views of the drawings.

DESCRIPTION OF THE PREFERRED EMBODIMENT

Figure 3:
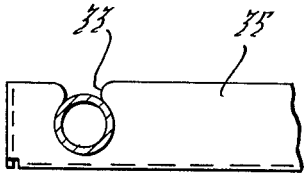
FIG. 3 is an enlarged section taken along line 3—3 of FIG. 1.
Figure 4:
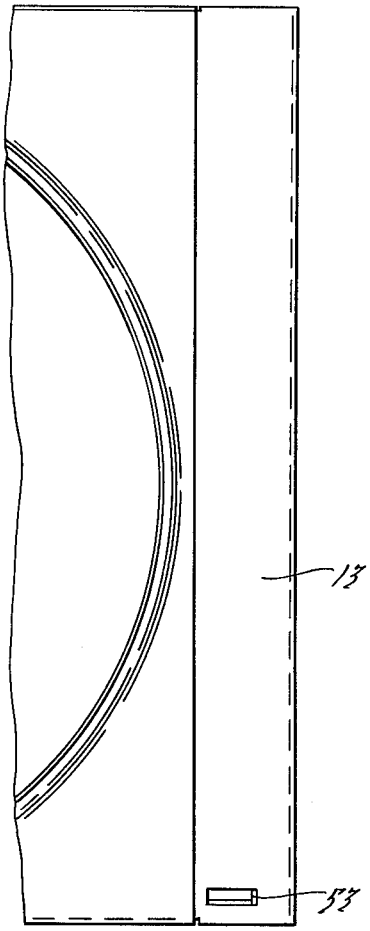
FIG. 4 is an enlarged view looking generally in the direction of the arrow A in FIG. 1.

Referring now to the drawings, refrigeration apparatus of this invention is generally shown in FIG. 1. It includes a housing 1 having a floor or base 3 which supports and mounts an evaporator coil 5, a motor-driven compressor 7 and a condenser coil 9. A fan 11 is provided for forcing air over the condenser coil 9. The condenser coil 9 is separated from other components mounted on the base by a shroud generally designated 13. The refrigerant circuitry for the closed system includes a conduit on line 15, referred to as a suction line which provides a path for refrigerant leaving the evaporator 5 to pass to the compressor 7. The refrigerant is in a gaseous state as it passes from the evaporator 5 to the compressor 7. In the compressor the refrigerant is compressed and is discharged through a discharge line 17 to the condenser coil 9. As the refrigerant passes through the condensing coil 9 it is liquified as a result of the cooling air passing over the condenser coil 9 under the influence of fan 11. The liquid refrigerant passes through an outlet at the lower end of the condenser coil 9 through a line 19 which is connected to the sub-cooling coil 21, described in more detail hereinafter. The sub-cooling coil 21 is connected by a line 23 to lines 25 and 27 which deliver the sub-cooled liquid refrigerant to the evaporator 5.

It will be understood that as heat is removed from air passing over the evaporator coil 5 moisture is removed therefrom. This moisture is collected in a sump or recessed portion 29 formed in base 3 or in an insert located on top of base 3 and under coil 5. The sump 29 allows the condensate water to drain back to a tube 31 connected to the recessed portion. The rearward end of tube 31 passes through a holding slot 33 in a dam member 35 which is adapted to extend from the shroud 13 across to the side of base 3. This dam 35 cooperates with the sides 37 and 39 of base 3 and portions 41 and 43 of condenser shroud 13 to form a reservoir or pool 45 in which the coil 21 is located. Condensate water passes from the recessed portion 29 through the line 31 into the reservoir 45.

Figure 5:
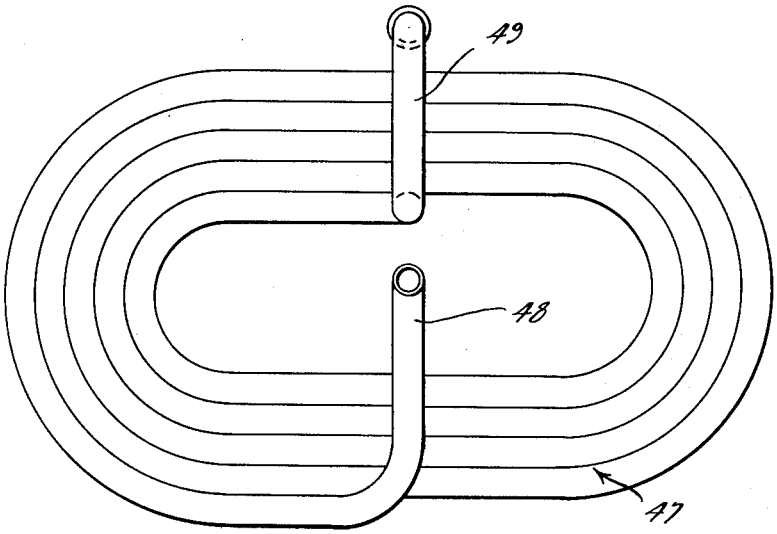
FIG. 5 is an enlarged fragmentary view of FIG. 1, the view being rotated clockwise 90°.
Figure 6:
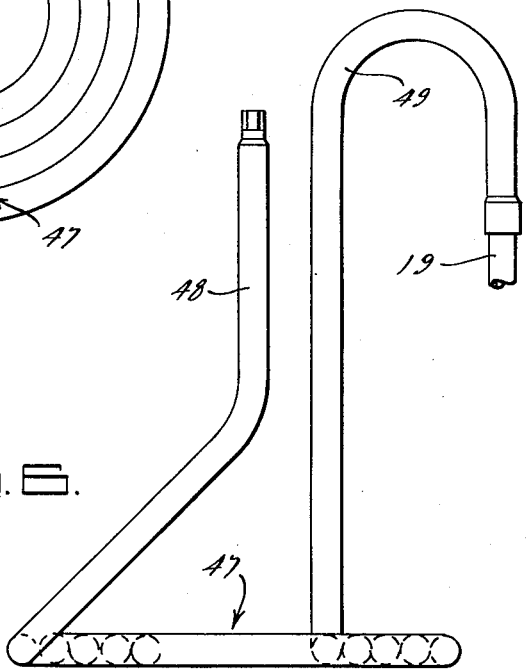
FIG. 6 is a side elevation of the apparatus shown in FIG. 5.

The sub-cooling coil 21 is more particularly shown in FIGS. 5 and 6 and includes a coiled portion 47, substantially flat and generally spiralled in configuration, and adapted to be located flat on the floor or base 3.

It will be seen that the line 19 from the condenser coil 9 is attached to a hook-shaped portion 49 of the coil. Hook-shaped portion 49 is integrally connected to the flat portion 47 at one end of the latter. The other end of the flat portion 47 is integral with a portion 48 which extends upwardly therefrom and is secured and connected to line 23.

The end of end portion 41 of the shroud 13 is provided with a punched opening or slot 53 at a height which is greater than the thickness of the flat portion 47 of coil 21. Thus, while condensate water is allowed to drain into the reservoir 45 and increase to a depth which covers the sub-cooling coil flat portion 47, the opening 53 prevents the depth of the pool of condensate water from increasing to a point where it would flow over dam 35 back into the forward compartment of the room air-conditioner. The water flows through opening 53 into the condenser coil section where it is discharged through an opening not shown to the atmosphere.

It will be seen that as the condensate water is formed it passes from the recessed portion 29 through the tube 31 into the reservoir 45 and around the flat portion 47 of the sub-cooling coil 21. The depth of the condensate water continues to increase until the coil portion 47 is covered. The water then passes through slots 53 in the end portion 41 of the shroud 13 into the condenser section. Accordingly, as the refrigerant condensed in condenser 9 passes therefrom it is sub-cooled in coil 21 prior to being delivered to the evaporator 5. Thus, the condensate water produced as a result of warm air being forced over the evaporator 5 is utilized to increase the cooling and efficiency of the refrigeration apparatus.

In view of the foregoing it will be seen that the several objects and advantages of this invention are achieved.

Although only one embodiment of the invention has been disclosed and described, it is apparent that other embodiments and modifications of the invention are possible.

We claim:

1. Refrigeration apparatus including a housing, an evaporator, a compressor, a condenser coil, and conduit means connecting said evaporator to said compressor, said compressor to said condenser coil, and said condenser coil to said evaporator, subcooling means for cooling refrigerant passing from said condenser to said evaporator, said sub-cooling means including a sub-cooling coil in said conduit means, means for facilitating the removal of heat from said sub-cooling coil including means for forming a reservoir around said coil and means for delivering condensate from said evaporator coil to said reservoir, and means for preventing the depth of condensate in said reservoir from exceeding a predetermined depth, said last means comprising a wall portion adjacent said condenser coil, and an opening in said wall portion for allowing condensate to flow from said reservoir to said condenser coil.

2. The refrigeration apparatus of claim 1 wherein said sub-cooling coil includes a plurality of integrally formed coils in a generally flat and spiral configuration located adjacent said base.

* * * * *